United States Patent [19]

Miura

[11] Patent Number: 4,492,571

[45] Date of Patent: Jan. 8, 1985

[54] BAKING AND DRYING FURNACE FOR CONTAINERS SUCH AS CANS

[75] Inventor: Hideo Miura, Yokohama, Japan

[73] Assignee: Toyo Seikan Kaisha, Ltd., Japan

[21] Appl. No.: 403,359

[22] Filed: Jul. 30, 1982

[30] Foreign Application Priority Data

Jul. 31, 1981 [JP] Japan ..... 56/112863[U]
Aug. 3, 1981 [JP] Japan ..... 56/120730
Aug. 3, 1981 [JP] Japan ..... 56/120731

[51] Int. Cl.[3] ..... F24J 3/00; F26B 25/00

[52] U.S. Cl. ..... 432/225; 432/59; 34/105

[58] Field of Search ..... 432/59, 224, 225; 34/104, 105

[56] References Cited

U.S. PATENT DOCUMENTS

| | | | |
|---|---|---|---|
| 2,835,003 | 5/1958 | Abrams | 34/236 |
| 3,729,832 | 5/1973 | Lund | 34/34 |
| 3,755,916 | 9/1973 | Guloian | 34/105 |
| 4,053,993 | 10/1977 | Schregenberger | 34/105 |
| 4,092,099 | 5/1978 | Chiba et al. | 432/59 |
| 4,118,178 | 10/1978 | Calvi, et al. | 432/59 |
| 4,383,378 | 5/1983 | Lockwood | 34/105 |

*Primary Examiner*—Henry C. Yuen
*Attorney, Agent, or Firm*—Jordan B. Bierman

[57] ABSTRACT

This invention relates to a baking and drying furnace wherein hot air is supplied from the top of containers such as cans passing through the furnace in an inverted attitude and the hot air within the cans are suctioned whereby the hot air may flow along internal and external surfaces of the containers, the improvement wherein the containers are prevented from being tumbled by being flapped by a stream of hot air.

First, in order to prevent cans from being tumbled by being flapped by a turbulent flow of hot air which downwardly flows along the outside of containers such as cans resulting from impingement of hot air upon a can transporting passage, nozzles for suctioning hot air are arranged along said transporting passage to arrange the flowing direction of downwardly flowing hot air.

Secondly, in order to increase the force for pressing the containers to prevent them from being tumbled, a suction resistance of nozzles for suctioning hot air within the containers is decreased, and the diameter of a nozzle is determined so that a difference in pressure between internal and external sides of the container becomes its maximum.

Thirdly, in order to prevent the transporting belt from being displaced or levitated, the belt is slidably moved within the groove and suction nozzles are disposed on the bottom of the groove to attract the belt.

2 Claims, 12 Drawing Figures

FIG. 1
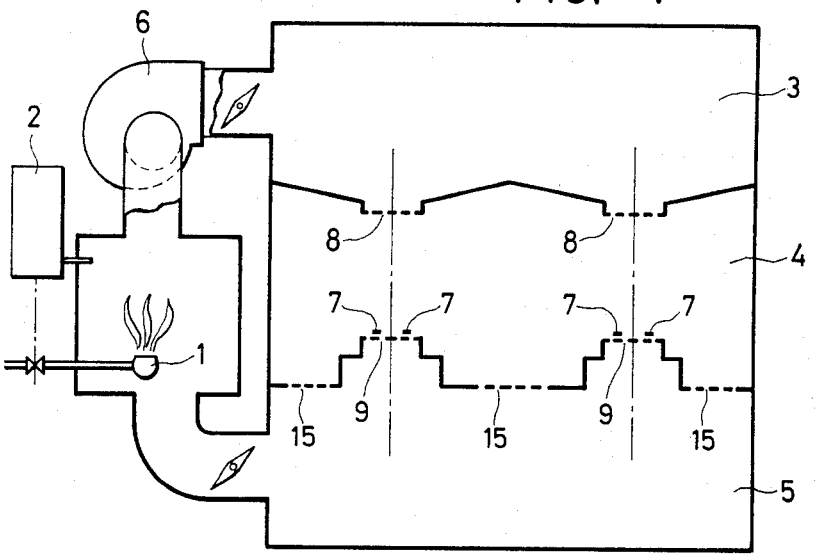
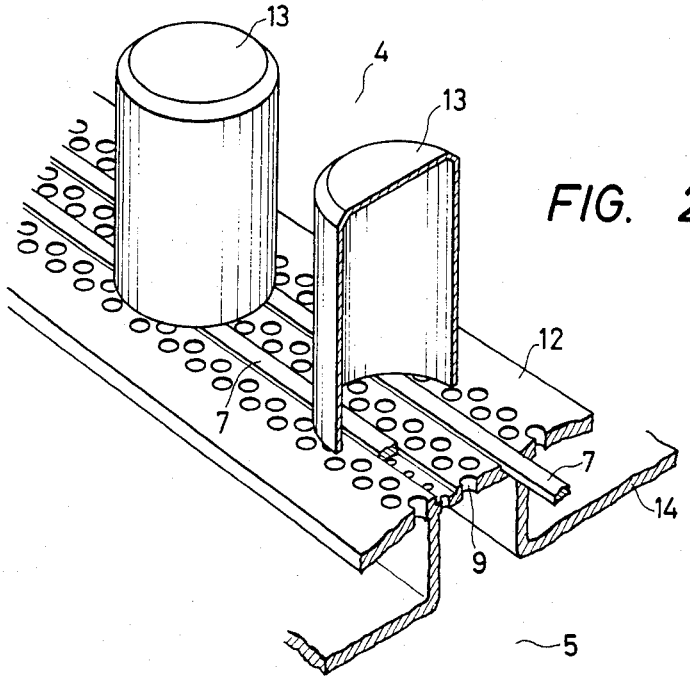
FIG. 2

BAKING AND DRYING FURNACE FOR CONTAINERS SUCH AS CANS

BACKGROUND OF THE INVENTION

1. Field of the Invention

This invention relates to an improvement in a baking and drying furnace for containers such as cans for canned food, which are coated or printed.

2. Description of the Prior Art

Where containers such as cans have been coated or printed for ornamental purposes, after which they are dried and baked, it has been heretofore customary to use a baking and drying furnace or oven known as a "pin oven". Coated and printed cans move while being hung on pins through the furnace under the atmosphere of high temperature. The furnace of this system is suffered from disadvantages in that since the can is heated only from the surface thereof, the heating efficiency is poor and that since the pin is in contact with the inner surface of the can, the furnace cannot be used to dry and bake the coating of the inner surface.

On the other hand, a baking and drying furnace has been recently made practicable, of the type in which a suction hole is disposed partly of an opening of a can which moves while being placed with an opening thereof directed downwardly through the furnace under the atmosphere of high temperature, and after the high temperature atmosphere within the furnace has been once flown into can from the other portion of the opening of the can, it is suctioned from the suction hole. (For example, see Japanese Patent Application Laid-open No. 52-143548)

The furnace of the type as described has various advantages in that since the can is heated from both inner and outer surfaces thereof by the high temperature atmosphere, the heating efficiency is extremely high, and that only the open edge of the can comes to contact with the transporting belt during the drying and baking, and the inner and outer surfaces of the can may be simultaneously coated and simultaneously dried and baked.

However, the can is retained on the transporting belt during the drying and baking only by a pressing force caused by a difference between atmospheric pressure within the furnace and atmospheric pressure within the can which is suctioned to be lowered. Because of this, a trouble in tumbling of cans during transportation occurs owing to curves or vibrations of transporting belts which often comprise metal belts such as stainless, and especially in cans such as beverage cans frequently used recently, the height of the can is greater than the diameter thereof and the centroid position thereof is high whereby the trouble of this kind tends to occur.

On the other hand, if an attempt is made to increase the pressing force by lowering the atmospheric pressure within the can, the suction force of the suction opening is naturally increased, as a consequence of which there poses problems in that the air stream is formed into a turbulent flow to blow down the can, or a coating on the surface of the can is carried away resulting in an uneven coated film, and as the case may be, the coating falls down and droplets thereof are suctioned and adhered to the inner surfaces of the can. Thus, the problems have not been solved merely by increasing the suction force. force.

SUMMARY OF THE INVENTION

This invention is to improve the aforementioned baking and drying furnace to thereby provide a furnace which is free from tumbling of cans.

A first object of the present invention is to improve a flow passage of hot air within the furnace to thereby prevent cans from being tumbled by a turbulent flow.

A second object of the invention is to improve a suction nozzle for suctioning hot air within the can to thereby increase a pressing force of the can with respect to a transporting belt thus preventing tumbling of cans.

A third object of the invention is to always maintain a transporting surface of the transporting belt on a stabilized plane to thereby prevent tumbling of cans.

In order to achive the first object, a row of nozzles for supplying and suctioning hot air into the can are made greater in width than that of the can to suction hot air even from the outside of the can, whereby a stream of hot air downwardly flowing along the outer surface of the can is prevented from being formed into a turbulent flow, and tumbling of the can is prevented by said turbulent flow.

In order to achieve the second object, the diameter of the nozzle for suctioning hot air within the can is made larger to minimize a pressure loss resulting from a resistance of the nozzle, as a consequence of which a difference in pressure between inner and outer portions of the can is made greater to increase a pressing force of the can against the transporting belt resulting from the pressure difference.

In order to achieve the third object, a groove is provided in a passage of the transporting belt and the belt having a greater thickness than that of prior art belts is used to thereby prevent lateral displacement or twist of the belt and a suction nozzle is provided on the bottom of the groove to thereby prevent the belt from being levitated.

BRIEF DESCRIPTION OF THE DRAWINGS

FIG. 1 is a schematic view of a baking and drying furnace in accordance with the present invention;

FIG. 2 is a perspective view showing a nozzle arrangement in a can transporting section;

DETAILED DESCRIPTION OF THE PREFERRED EMBODIMENTS

Figure 3:
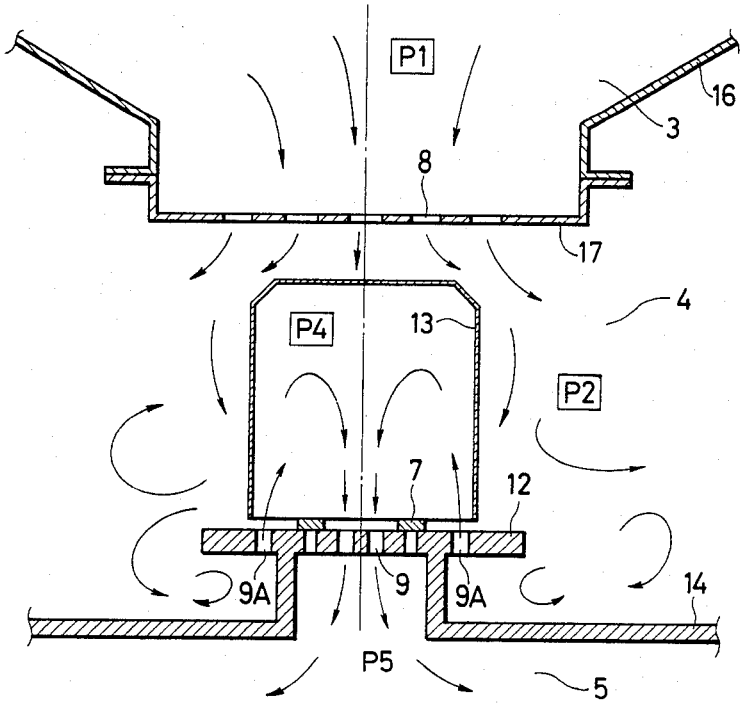
FIG. 3 is a view for explanation of the operating principle in a well-known device.

FIG. 1 is a sectional schematic view of a baking and drying furnace of the present invention which is at a right angle with respect to a transporting belt. A furnace body comprises an upper hot air supply chamber 3, a can passage chamber 4 and a hot air recovering chamber 5. Hot air for heating cans which pass through the furnace while being placed on a can transporting conveyor belt 7 is heated by means of a burner 1, delivered into the hot air supply chamber 3 by means of a recirculation blower 6, injected from a hot air blow nozzle 8 to heat the cans, and suctioned by means of a hot air suction nozzle 9 for recirculation. In the drawings, reference numeral 2 designated a heating control device and 15 denotes an auxiliary recovering nozzle for rendering an air stream within the can passage chamber steady state.

FIG. 2 is a partially cutaway perspective view showing a state wherein a can 13 is transported on the hot air blow nozzle 9 by means of the can transporting belt 7. The can 13 integrally formed with a bottom by drawing, contouring, etc. is placed with an open portion thereof directed downwardly on the transporting belt 7 for transportation. In the drawings, reference numeral 14 designates a partitioning wall between the can passage chamber 4 and the hot air recovering chamber 5.

FIG. 3 illustrates the retaining force of the can and a hot air flow passage in a well-known baking and drying furnace of the type as described. That is, hot air blown downwardly from the blow nozzle 8 provided on a blow nozzle plate 17, which is detachably disposed by means of suitable clamping means, bolting, etc., is suctioned through the suction nozzle 9 and recirculated as described hereinbefore. At this time, in a portion where the suction blow nozzle 9 is covered with the can 13 as shown, hot air of a volume portion in the can is suctioned into the recovering chamber 5 by negative pressure produced by the recirculation blower 6 through the suction nozzle 9. Therefore, atomspheric pressure within the can lowers so that hot air within the can passage chamber 4 is suctioned into the can through an outer suction nozzle 9A. Namely, there is established the following relation:

$$P_5 < P_4 < P_2 < P_1$$

where $P_1$ is pressure within the hot air supply chamber, $P_2$ is pressure within the can passage chamber, $P_4$ is pressure within the can, and $P_5$ is pressure within the hot air recovering chamber. Due to the pressure difference as just mentioned, hot air is injected into the can passage chamber from the hot air supply chamber to heat the can 13, suctioned into the can to heat the interior of the can, then suctioned into the recovering chamber 5 and recirculated by the blower. At the same time, let S represent the sectional area of the can 13, then the pressing pressure as given below is generated due to said pressure difference, $$P = S\,(P_2 - P_4)$$

and the can 13 is pressed against the can transporting belt 7 to thereby act as the can retaining force.

Generally, at this time, the outer suction nozzle 9A is arranged in width within the width substantially equal to the diameter of the open portion of the can. This imparts a symmetricalness to air streams internally and externally of the can, imparts an automatic centering action to the can position on the transporting belt 7 and imparts the stability to the conveyance of the can.

Because of this, however, in a portion at a right angle with respect to the moving direction, the flow of hot air along the wall surfaces of the can is extremely weak as compared with other portions to partly deteriorate the heat treatment effect of the can and hot air blocked at the end of the suction nozzle constituting member 12 is turbulent to conversely result in impairment of the stability of the can conveyance.

Figure 4:
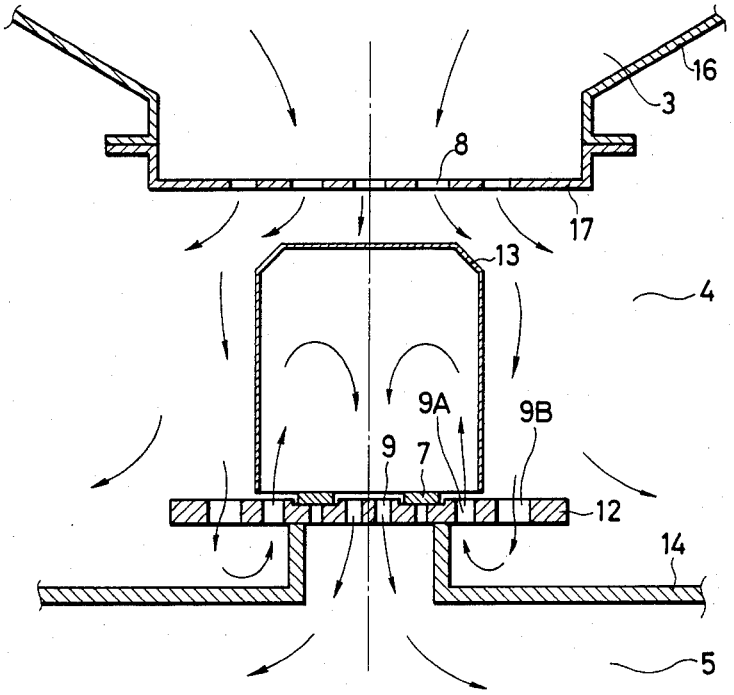
FIG. 4 is a sectional view of a can transporting section in a first embodiment in accordance with the present invention.

On the other hand, in the suction nozzle of the present invention, if the outer suction nozzle is disposed in width sufficiently greater than the diameter of the open portion of the can, the flow of hot air along the wall surfaces of the can at the portion at a right angle to the moving direction is also uniformed by the air stream suctioned by the nozzle 9B externally of the can, as shown in FIG. 4, and it becomes possible to achieve the uniform heat treatment effect for the can.

Figure 5:
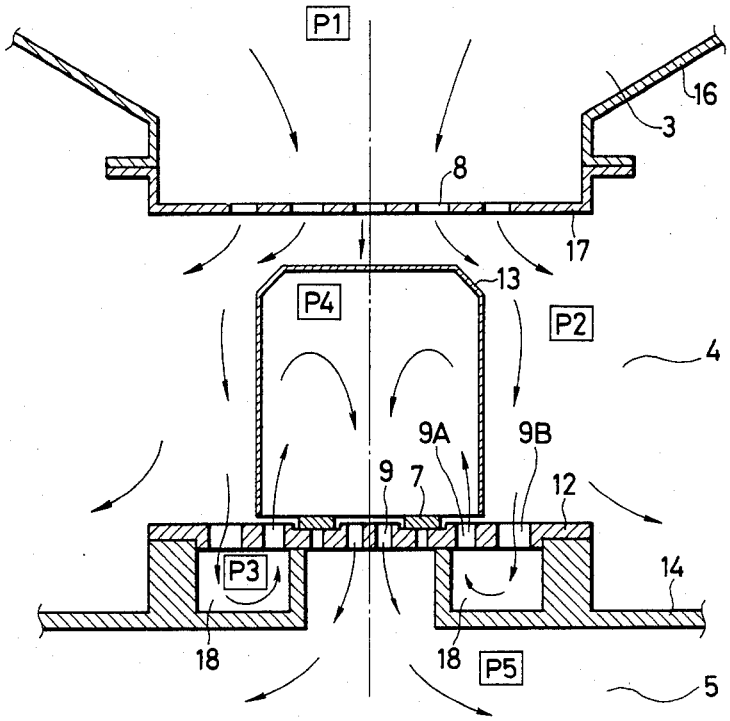
FIG. 5 is a sectional view of a can transporting section in another embodiment.

In order to further increase such an effect as described, it is preferable that as shown in FIG. 5, externally of the transporting belt 7 and between the recovering chamber 5 and the suction. nozzle constituting member there is provided a hot air reservoir 18 having suction nozzles 9A and 9B on the upper surface thereof and extending lengthwise of the transporting belt 7.

The air stream for heating the can 13 forms its flow passage in which said air stream once enters the reservoir 18 from the can passage chamber 4 through the suction nozzle 9B, flows into the can from the suction nozzle 9A and is then recovered by and into the hot air recovering chamber 5 from the suction nozzle 9. Let $P_3$ represent the pressure within the reservoir 18, then the relationship given below is established similarly to the foregoing:

$$P_5 < P_4 < P_3 < P_2 < P_1$$

and the can retaining force is likewise given by $$P = S\,(P_2 - P_4).$$

However, between the reservoir and the can passage chamber there generates a pressure difference given by $$P_3 - P_4$$

and all the suction nozzles externally of the transporting belt 7, except those covered by the cans including the inner nozzle 9A not covered with the can, function as suction nozzles whereby no turbulence and irregular flow occur in the neighbourhood of the can 13 and suction nozzle 9, thus rendering possible extremely effective heat treatment of can and stabilized conveyance thereof.

As described hereinbefore, finally, the hot air flowing down from the blow nozzle 8 is recovered from the suction nozzle 9 provided halfway of the transporting belt 7 but since normally, the open area of the suction nozzle is much smaller than the open area of the blow nozzle, it has been necessary to have a high suction air velocity caused by great negative pressure. However, the suction air velocity and suction negative pressure are necessary to be determined by taking various factors such as heat treatment effect relative to the can, transporting attraction of the can, flow- and falling off of coatings coated on the can surface into consideration and cannot be determined only by the balance between the blow air quantity and suction air quantity. Thus it has been difficult to secure stabilization of the stream of hot air.

In the furnace of the present invention, a row of auxiliary recovering nozzles, as indicated at 15 in FIG. 1, are evenly or discontinuously disposed parallel to the can transporting belt over the full length of the furnace. Thereby, the suction air quantity and air velocity of the suction nozzle 9 may be set to an optimum value while always flowing a sufficient amount of hot air of the blow nozzle and the difference between the blowing quantity and suctioning quantity may recovered from said auxiliary recovering nozzle row 15 to thereby maintain the maximum performance of the entire furnace.

As the setting conditions of the suction nozzle 9 change, the opening rate of the auxiliary recovering nozzle 15 is varied steplessly, for example, by a shutter, or the nozzle constituting member having the nozzle row of various opening rates is detachably mounted so that they may be exchanged as necessary. In this manner, the air stream within the can passage chamber 4 may be made steady to avoid an occurrence of irregular turbulence.

In accordance with the present invention, the suction nozzles not covered with the cans are provided on both external sides of the can transporting belt as described hereinbefore to thereby form the flow of hot air along the can walls into a steady flow and to form the flow of hot air in the can passage chamber into an ordery flow by means of the auxiliary recovering nozzles, thus preventing troubles such as tumbling of cans caused by the turbulence and rapidly increasing the heat treatment ability of the can portion at a right angle to the transporting direction to render the uniform drying and baking possible.

Figure 6:
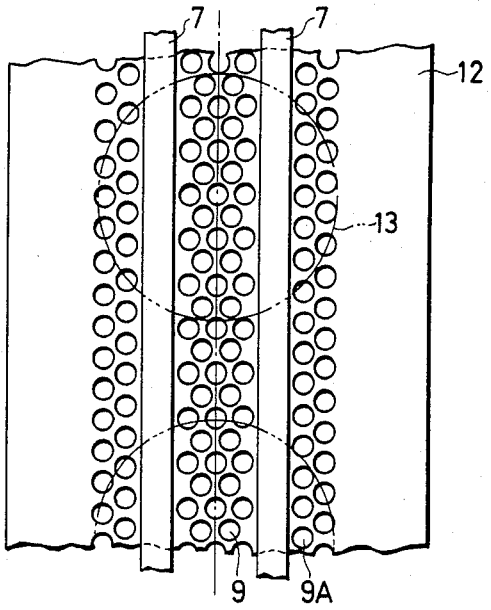
FIG. 6 is a plan view showing a nozzle arrangement of a well-known device.

On the other hand, in the prior art devices, it has been considered to be reasonable that uniform treatment may be applied to the entire circumference of the can by arranging hot air suction nozzles distributed as even as possible and with high density facing to the can passage, and therefore, it has been customary that the open orifice diameter of the individual nozzle 9 is normally made to have a small diameter which is 1/10 or less of the diameter of the open end of the can, as shown in FIG. 6.

Figure 7:
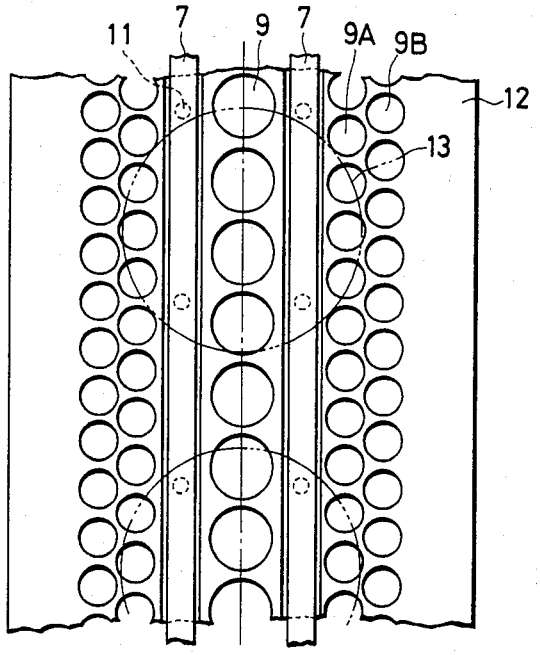
FIG. 7 is a plan view of a nozzle arrangement of the device in accordance with the present invention.

However, the present inventor has discovered as the result of various experiments that it is desirable to make the open orifice diameter of these nozzles larger instead as shown in FIG. 7.

The reason therefor is considered as follows: As mentioned hereinbefore, hot air blown from the hot air supply chamber through the nozzle 8 is suctioned from the suction nozzle 9 for recirculation. At this time, in the portion where the suction nozzle 9 is covered with the can 13 as shown, hot air of a volume portion within the can is suctioned into the recovering chamber 5 by negative pressure generated by the recirculation blower 6. Because of this, atmospheric pressure within the can lowers so that hot air within the can passage chamber 4 is suctioned into the can through the outer suction nozzle 9A. At this time, let $P_1$ represent the pressure within the hot air supply chamber 3, $P_2$ the pressure of the can passage chamber 4, $P_4$ the pressure inside the can, and $P_5$ the pressure of the hot air recovering chamber 5, then the following relation is established $$P_5 < P_4 < P_2 < P_1.$$

If the resistance of the suction nozzle 9 is great, the suction pressure $P_s = P_4 - P_5$ is high, and the retaining force $P_h = P_2 - P_4$ of the can 13 becomes small. In addition, as already mentioned, if the suction pressure is high, the suction flow velocity is high, giving rise to troubles such as a drip of coatings.

On the other hand, if the diameter of the suction nozzle is made greater, the suction resistance caused by the nozzle lowers and thus, the pressure $P_s = P_4 - P_5$ becomes small whereas the retaining force $P_h = P_2 - P_2$ increases through that amount, whereby the great retaining force of the can is produced by the small negative pressure of the recovering chamber 5. The experiment results in connection with the above-mentioned facts are shown in FIGS. 8 and 9.

Figure 8:
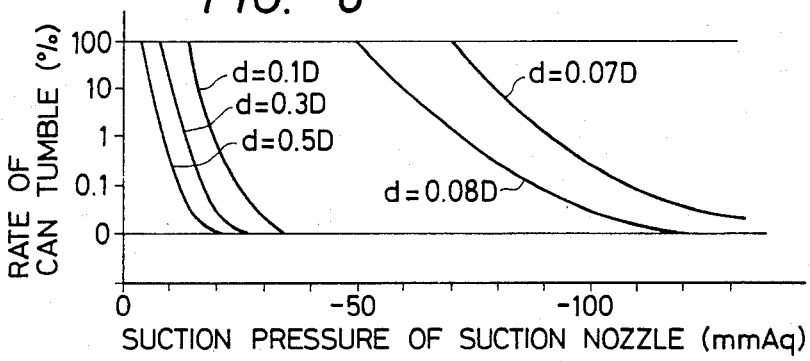
FIG. 8 is a graph showing the relation between the rate of occurrence of can tumbling and the nozzle diameter.

FIG. 8 shows the rate of occurrence of can tumble relative to the nozzle diameter d in the case the suction pressure of the nozzle 9 is changed, in which example of experiment, if the nozzle diameter d as in those heretofore used is smaller than 1/10 of the diameter of the can, it is not possible to make the rate of can D tumble zero unless suction negative pressure is above −100 mm Aq, whereas if the diameter d is 0.5 D, it is possible to make the rate of can tumble almost zero under negative pressure of only −20 mm Aq.

Figure 9:
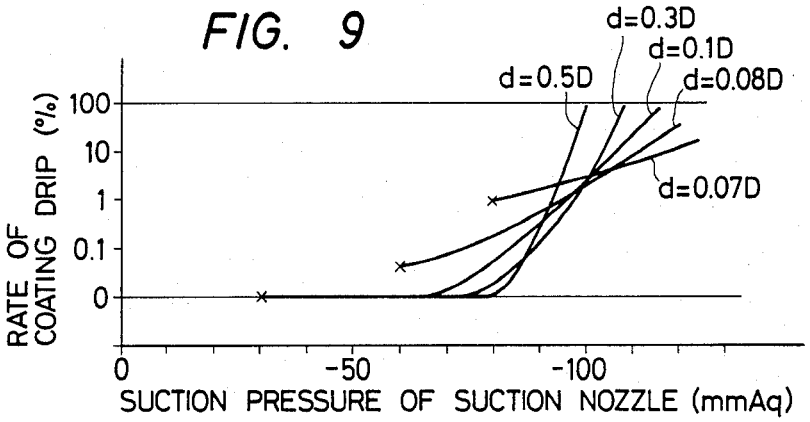
FIG. 9 is a graph showing the relation between the rate of coating dripping and the nozzle diameter.

On the other hand, with respect to the rate of occurrence of coating drip, as seen in FIG. 9, in the case the dried and coated film is 150 mg/dm$^2$, if the nozzle diameter d is equal to 0.1 D with respect to the can diameter D, the rate of occurrence will be zero under the suction negative pressure of −65 mm Aq or below, whereas if d is equal to 0.08 D, the rate of occurrence of tumble will never be zero even in terms of the fact (mark x in the figure) that the measurement of the rate of occurrence of tumble is made impossible due to the occurrence of can tumble.

Figure 10:
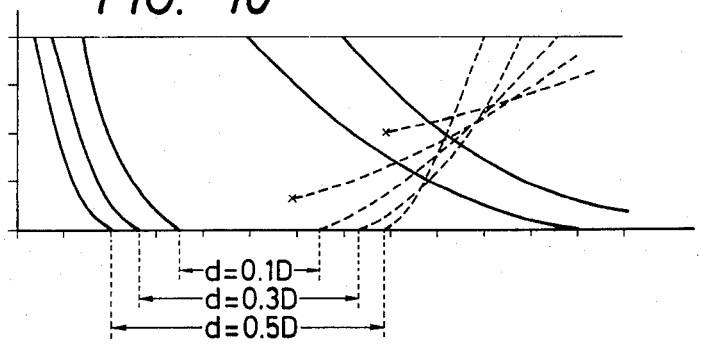
FIG. 10 is a graph showing the relation between the nozzle diameter and the usable blown negative pressure.

FIG. 10 is a view in which FIGS. 8 and 9 are combined. As is apparent from FIG. 10, in the value smaller than the nozzle diameter d=0.1 D heretofore used, no region of negative pressure is present which can make both the rate of occurrence of a can tumble and the rate of occurrence of a coating drip zero.

The larger the nozzle diameter d as compared with the can diameter D, the better. However, as shown in FIG. 7, the can diameter D need to cover the nozzle 9, the transporting belt 7 and outer suction nozzle 9A, and when the outer suction nozzle 9A is excessively small, hot air flowing into the can is minimized to decrease the heating effect from the interior of the can.

Therefore, a limit of the diameter of the nozzle 9 is 0.5 D. It is therefore desirable from the above-described reasons that the diameter of the outer suction nozzle 9A is in the range of $d = 1/10D - \frac{1}{3}D$.

Figure 11:
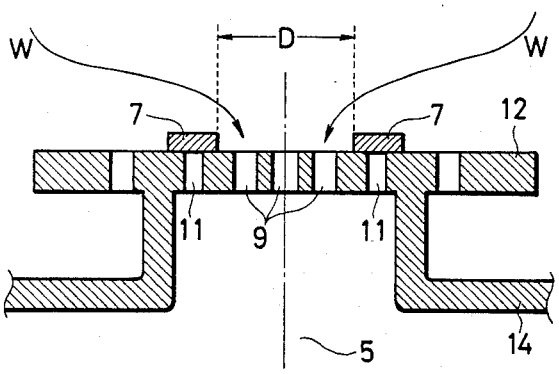
FIG. 11 is an enlarged sectional view of a transporting conveyor sliding portion of a well-known device.
Figure 12:
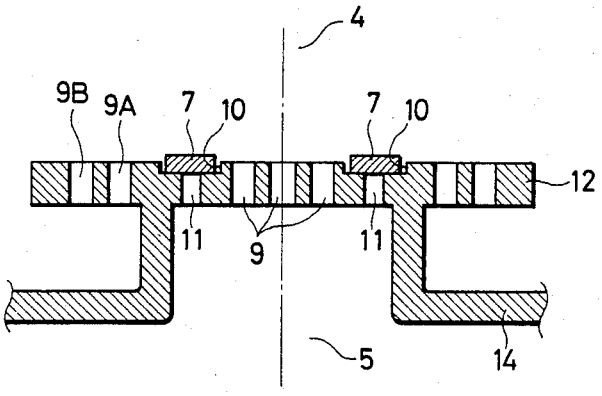
FIG. 12 is an enlarged sectional view of a transporting conveyor sliding portion of the device in accordance with the present invention.

In the prior art devices, since the transporting belt 7 is installed along the upper surface of the suction nozzle constituting member 12, as shown in a fragmentary sectional view of FIG. 11, the belt 7 is carried away by hot air W directly suctioned and flown into the suction nozzle 9 between the cans 13 and a phenomenon wherein spacing D is changed has been appeared. In addition, the belt 7 involves minor twist and internal stress so that sometimes, the belt 7 is flapped by the hot air W and is then levitated from the upper surface of the nozzle constituting member 12, which results in a tumble of the can 13 to be transported.

This tendency is further encouraged, even in a portion where the can 13 is placed on the transporting belt, by the fact that the hot air flowing down along the can 13 impinges upon the end of the suction nozzle constituting member 12 into a turbulent flow as shown in FIG. 3. That is, if the can 13 is shaken by said turbulent flow, a tendency is increased in which the belt 17 is inwardly carried by the air stream passed under the levitated can 13 and directly suctioned by the suction nozzle 9 along the upper surface of the suction nozzle constituting member 12, thus increasing a tendency in which the shaking can 13 tends to be tumbled.

On the other hand, in accordance with the apparatus of the present invention, there is provided a set of conveyor belts composed of two belts, along the passages of which are provided belt sliding guide grooves 10 which are slightly shallower than the thickness of the belt 7, and the belts 7 are laid in said grooves and belt attracting nozzles 11 are disposed in the bottom of the grooves.

With this arrangement, it is possible to prevent the spacing of the belt 7 from being narrowed by hot air W directly sunctioned by the suction nozzles between the cans placed on the belt.

Even if the thickness of the belt is increased, the gap between the can 13 and the upper surface of the suction nozzle constituting member 12 can be made smaller, and therefore, the hot air suctioned into the can is one which merely passes by the suction nozzle 9A externally of the belt to circulate the hot air deeply into the can 13 and to decrease the force laterally acting on the belt 7 at that portion.

It is possible to prevent the belt 7 from being levitated by the belt attracting nozzle 11 at the bottom of the groove 10, but there is no air stream passed under the belt 7 from the side and attracted by the nozzle 11 even if the belt 7 is slightly distorted because of the presence of the groove, whereby the belt 7 may be positively attracted.

By these marked operations and effects as described above, it is possible to extremely effectively prevent cans from being tumbled in the baking and drying furnace.

What is claimed is:

1. A baking and drying furnace for containers comprising (A) a hot air supply chamber, (B) a container passage chamber, (C) a hot air recovery chamber, and (D) a hot air reservoir.

wherein said container passage chamber and said recovery chamber are connected by first and second suction nozzles and said hot air reservoir and said container passage chamber are connected by third and fourth suction nozzles wherein said first, second and at least one row of said third suction nozzles are located so that when a container is placed in said furnace, said first, second and at least one row of said third suction nozzles are covered by the inside diameter of said container and at least one row of said fourth suction nozzles is located externally of the outside diameter of said container, whereby hot air moves substantially from said hot air supply chamber, passes through said passage chamber, said fourth suction nozzles, into said hot air reservoir, through said third suction nozzles into the interior portion of said container, and through said first suction nozzles into said recovery chamber, and wherein said second suction nozzles are covered by a means for transporting said containers through said furnace, wherein said first suction nozzles are one tenth to one half the inside diameter of said container, said third suction nozzle are one tenth to one third of said container diameter, and said means for transporting said containers comprises conveyor belts, said conveyor belts being laid in sliding belt guide grooves and covering the said second suction nozzles whereby said belt is attracted to said groove.

2. The furnace of claim 1 wherein auxiliary hot air suction nozzles are provided over the full length of said furnace.

* * * * *